US007926787B2

(12) United States Patent
Wieland

(10) Patent No.: US 7,926,787 B2
(45) Date of Patent: Apr. 19, 2011

(54) ELEVATED PLATFORM AND METHOD OF ELEVATING THE SAME

(75) Inventor: Craig Wieland, Mason, MI (US)

(73) Assignee: Blue Sky Decks, LLC, Lansing, MI (US)

( * ) Notice: Subject to any disclaimer, the term of this patent is extended or adjusted under 35 U.S.C. 154(b) by 1150 days.

(21) Appl. No.: 11/602,603

(22) Filed: Nov. 21, 2006

(65) Prior Publication Data

US 2008/0116018 A1 May 22, 2008

(51) Int. Cl.
*B66F 3/35* (2006.01)

(52) U.S. Cl. ..... 254/93 HP; 254/93 R

(58) Field of Classification Search ..... 254/93 HP, 254/2 B, 93 H, 93 R; 187/401; 248/125.8, 248/58

See application file for complete search history.

(56) References Cited

U.S. PATENT DOCUMENTS

| | | | | | |
|---|---|---|---|---|---|
| 1,745,959 | A | * | 2/1930 | Steiner | 92/44 |
| 3,015,470 | A | * | 1/1962 | Patchen | 254/93 HP |
| 3,174,722 | A | * | 3/1965 | Alm | 254/93 HP |
| 3,673,975 | A | * | 7/1972 | Strauss | 114/264 |
| 3,695,582 | A | * | 10/1972 | Clay | 254/93 HP |
| 4,061,310 | A | | 12/1977 | Vetter | |
| 4,074,474 | A | | 2/1978 | Cristy | |
| 4,930,598 | A | * | 6/1990 | Murrill et al. | 182/69.5 |
| 4,948,107 | A | * | 8/1990 | Orndorff, Jr. | 254/93 HP |
| 4,967,985 | A | | 11/1990 | Deakin | |
| 5,347,949 | A | | 9/1994 | Winston | |
| 5,506,012 | A | * | 4/1996 | Wright et al. | 428/35.2 |
| 5,542,806 | A | * | 8/1996 | Kang | 414/422 |
| 5,593,352 | A | | 1/1997 | Methfessel et al. | |
| 5,695,173 | A | * | 12/1997 | Ochoa et al. | 254/122 |
| 5,743,049 | A | | 4/1998 | Thallemer | |
| 5,775,847 | A | | 7/1998 | Carlinsky et al. | |
| 5,904,446 | A | | 5/1999 | Carlinsky et al. | |
| 6,000,942 | A | | 12/1999 | Hogue et al. | |
| 6,082,708 | A | * | 7/2000 | Mullican et al. | 254/93 HP |
| 6,092,788 | A | * | 7/2000 | Simon | 254/93 HP |
| 6,199,827 | B1 | * | 3/2001 | Rimington et al. | 254/93 HP |
| 6,640,934 | B1 | * | 11/2003 | Edwards | 187/239 |
| 6,834,404 | B2 | * | 12/2004 | Fletcher | 5/611 |
| 6,929,249 | B1 | * | 8/2005 | Kim | 254/93 HP |
| 7,070,167 | B1 | * | 7/2006 | Bacon et al. | 254/93 HP |
| 7,264,226 | B2 | * | 9/2007 | Smith et al. | 254/93 R |
| 2008/0116018 | A1 | * | 5/2008 | Wieland | 187/401 |

OTHER PUBLICATIONS

International Preliminary Report on Patentability for corresponding case PCT/US07/085343 dated May 26, 2009.

International Search Report for PCT/US07/85343 dated May 13, 2008.

Written Opinion for PCT/US07/85343 dated May 13, 2008.

* cited by examiner

*Primary Examiner* — Lee D Wilson

(74) *Attorney, Agent, or Firm* — Brinks Hofer Gilson & Lione

(57) ABSTRACT

An elevated platform is provided. The elevated platform includes a platform and a housing. A bladder that includes a first surface is coupled with and operative to elevate the platform. The first surface is operative outside the housing. Other embodiments are provided, and each of the embodiments described herein can be used alone or in combination with one another.

42 Claims, 9 Drawing Sheets

1140
$C_{S4}$
100
$C_{S1}$
130
$C_{S3}$
145
200
$C_{S2}$
300
205
H
250
120
620
620
110
620
$C_{H1}$
$C_{H3}$
$C_{H2}$

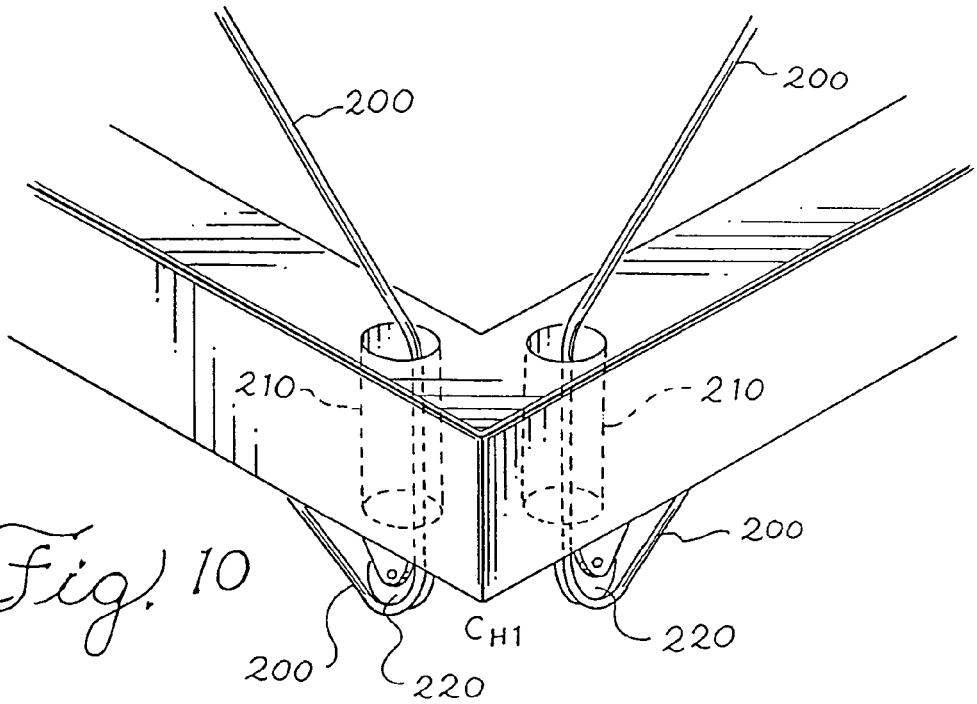
Fig. 10
Fig. 11A
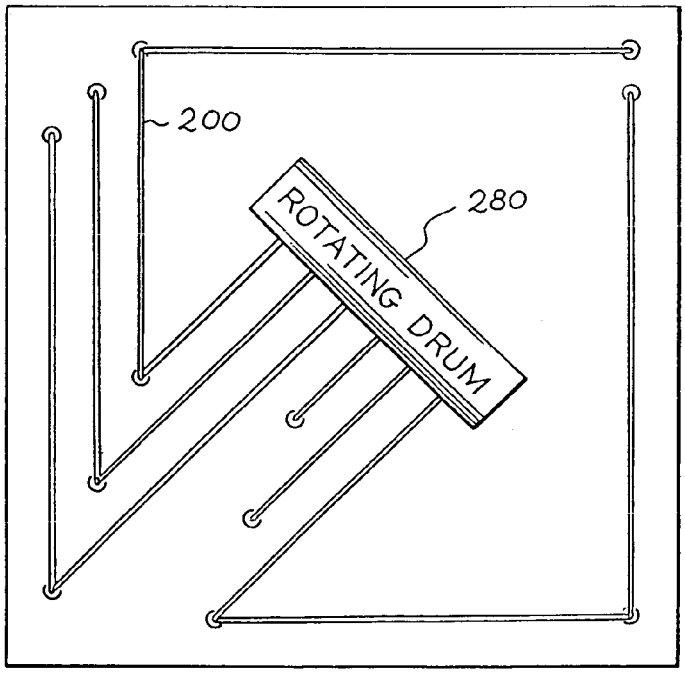

ELEVATED PLATFORM AND METHOD OF ELEVATING THE SAME

BACKGROUND

Various platforms are used to provide unobstructed views of sunsets, lakes, landscapes, mountains, local sporting events, or other visually appealing scenes. Platforms have also been used for other recreational activities. One common platform is the residential deck, which provides the user a measure of privacy. Generally, the residential deck is rigidly attached to the ground or a building and is unable to elevate to a desired variable height so as to obtain an unobstructed view of the surrounding area.

Conventionally, platforms have been raised using hydraulics, telescoping tubes, scissor lifts, or simply designing the platform at a predetermined height and accessing the platform using a ladder. These conventional mechanisms are expensive, complicated to install, or are dangerous to access. Accordingly, a simplified elevated platform is desired.

SUMMARY

The present invention is defined by the following claims, and nothing in this section should be taken as a limitation on those claims.

By way of introduction, the embodiments presented herein relate to an elevated platform. In one preferred embodiment, an elevated platform is provided including a platform and a housing. A bladder that includes a first surface is coupled with and operative to elevate the platform. The first surface is operative outside the housing. Other embodiments are provided, and each of the embodiments described herein can be used alone or in combination with one another The embodiments will now be described with reference to the attached drawings.

BRIEF DESCRIPTION OF THE DRAWINGS

FIG. 10 is a perspective view of one embodiment of a corner of the housing.

FIG. 11A is a bottom view of one embodiment of the housing.

DETAILED DESCRIPTION

Figure 1:
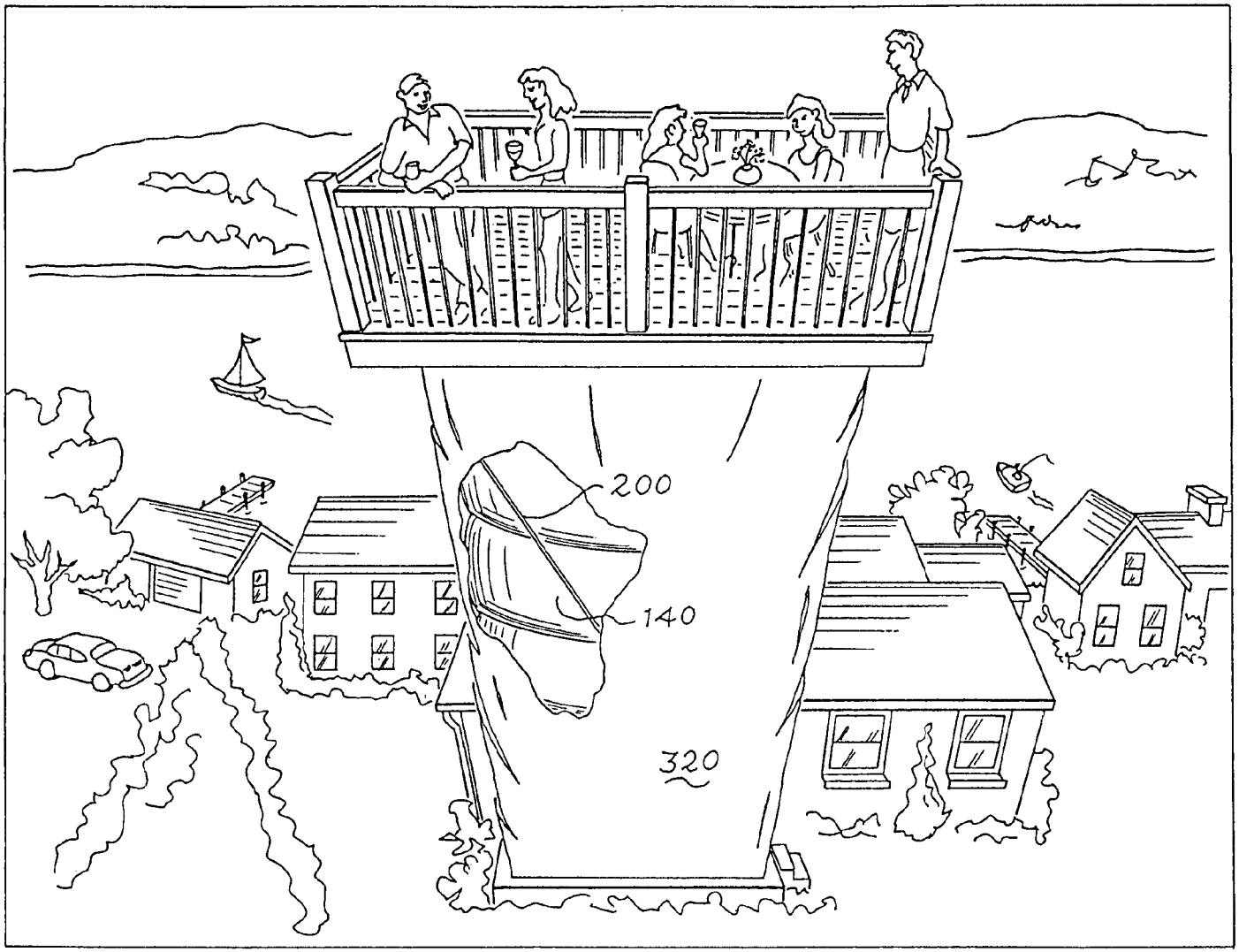
FIG. 1 is a perspective view of one embodiment of the elevated platform.
Figure 2:
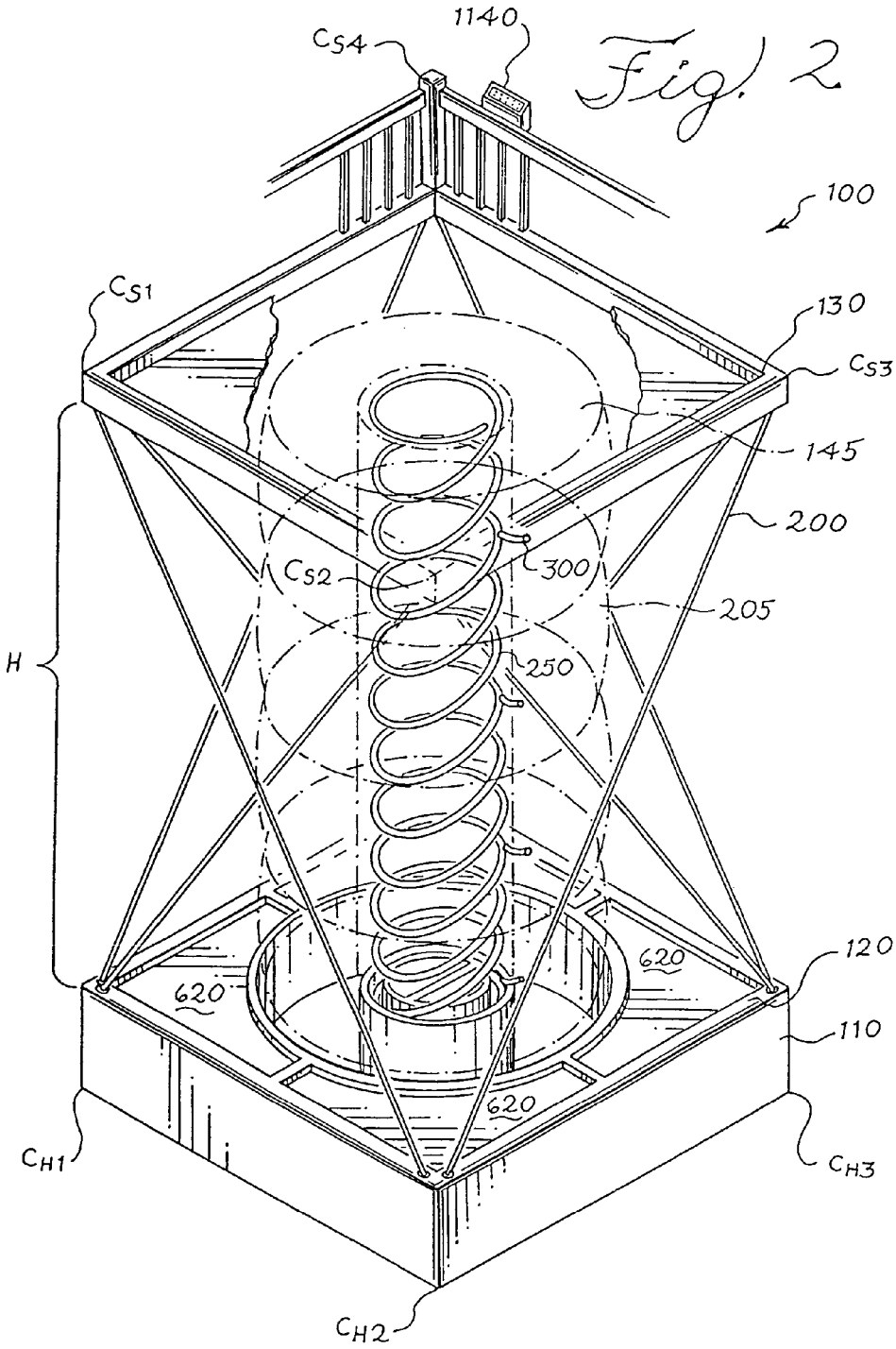
FIG. 2 is a perspective view of one embodiment of the elevated platform.

Turning now to the drawings, FIG. 2 illustrates an elevated platform 100 of a preferred embodiment. The elevated platform 100 comprises a housing 110, which, in this embodiment, is a box-like structure. However, the housing 110 can take any suitable form. For example, the housing 110 can be cylindrically shaped or embodied as a flat substrate. In the embodiment of FIG. 2, the housing 110 comprises a top housing surface 120 sized to support a first substrate 130. The top housing surface 120 is sized to support a first substrate 130 in that it is large enough to support at least a portion of the first substrate 130. Accordingly, the top housing surface 120 is sized to support a first substrate 130 when it is large enough to support the entire first substrate 130 or just a portion of the first substrate 130. In an alternative embodiment, the top housing surface 120 is the top surface of a storage tank. For example, the housing 110 may be embodied as one or more storage tanks. In this embodiment, the first substrate 130 may rest on, directly or indirectly, a storage tank when not in an elevated position.

The elevated platform 100 also comprises a bladder 140. The bladder 140 comprises a first bladder surface 145 that is coupled with the first substrate 130. As used herein, "coupled with" means directly coupled with or indirectly coupled with through one or more components, named or unnamed herein. The first bladder surface 145 can be coupled to the first substrate 130 using bolts, adhesive, u-clamps, steel straps, stitching, or other suitable attachment mechanisms. For example, the first bladder section 145 can be coupled to the first substrate 130 by placing a steel strap on or around a portion of the first bladder section 145. In another example, the first bladder surface 145 can be welded to the first substrate 130.

In one embodiment, the bladder 140 is disposed on the top housing surface 120. Alternatively, the bladder 140 is coupled to an inside portion of the housing 110. However, the bladder 140 is not limited to this position or location.

As shown in FIG. 2, in one embodiment, the bladder 140 is aligned on a center portion of the housing 110 and/or first substrate 130. As used herein, "center" means equally distanced from each corner of the first substrate. However, the bladder 140 is not limited to being aligned with a center portion of the housing 110 and/or first substrate 130. In an alternate embodiment, multiple surfaces (not shown) of the bladder 140 are coupled to the first substrate 130. The bladder 140 may also have multiple surfaces (not shown) that are coupled to the housing 110.

In another embodiment, the elevated platform 100 comprises multiple bladders that are disposed at different corners of the first substrate 130 and housing 110. For example, a bladder may be disposed at each corner of the first substrate 130. However, the multiple bladders are not limited to the corners of the first substrate 130 and/or housing 110, for example, bladders may be disposed in a triangle shape or at any suitable location on the first substrate 130 and housing 110.

Figure 4A:
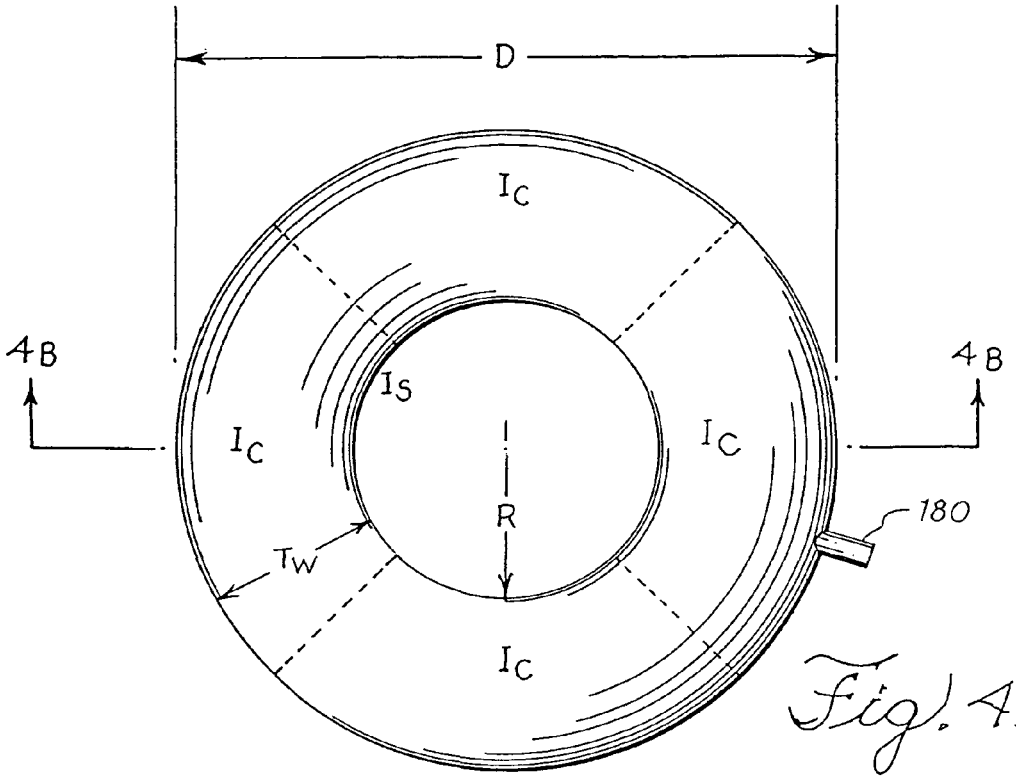
FIG. 4A is a top view of one embodiment of an inflatable bladder.
Figure 12:
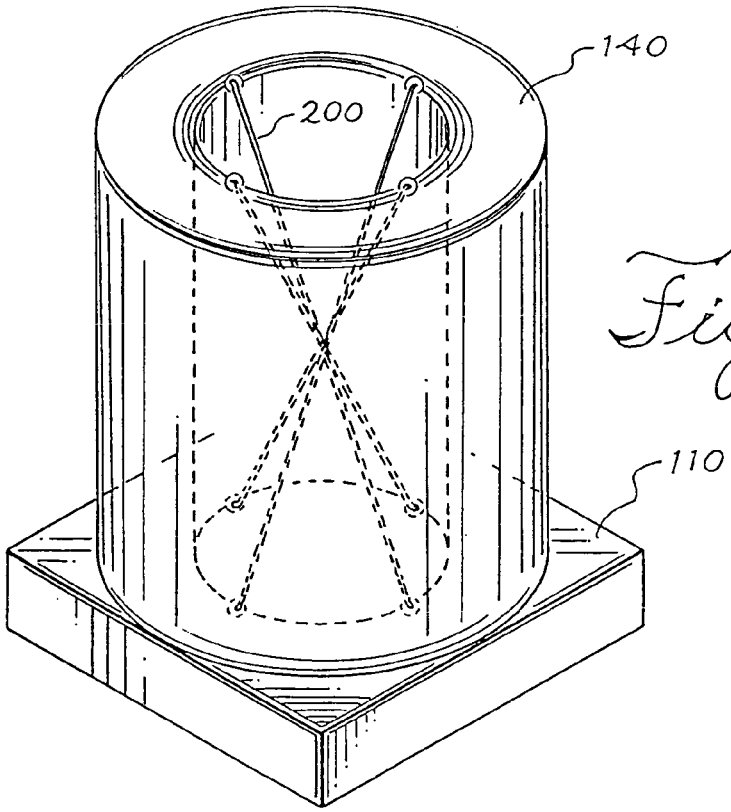
FIG. 12 is a perspective view of one embodiment of an elevated platform.

The bladder 140 can take any suitable form. In one suitable embodiment, as shown in FIG. 12, the bladder 140 comprises an elongated air-tight hollow body. However, the bladder is preferably cylinder shaped to assume a generally circular cross section. The bladder 140 is not limited to a particular shape. For example, the bladder 140 may have other cross-section configurations or take any suitable shape such as a rectangle, as shown in FIG. 12. In the embodiment shown in FIG. 12, the bladder 140 comprises a single hollow body with one compartment. However, the bladder 140 may comprise several vertical compartments inside the bladder 140. For example, the bladder 140 may include individual cells Ic inside the bladder 140, as shown in FIG. 4A. In this exemplary embodiment, the entire bladder 140 is not affected if one individual cell is ruptured.

Figure 4B:
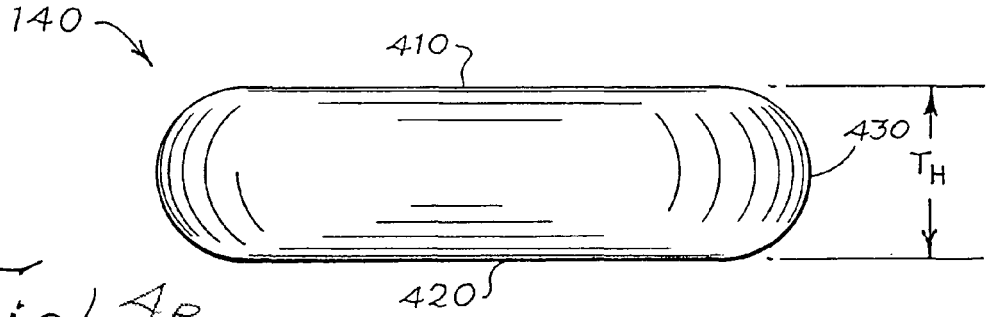
FIG. 4B is a side view of one embodiment of an inflatable bladder.

In one embodiment, as shown in FIG. 4B, the bladder 140 comprises a top region 410, a bottom region 420, and an outer wall 430. The top region 410 and bottom region 420 are substantially planar to each other when a force is applied to either the top or bottom. The outer wall 430 has a convex shape and is coupled to the top region 410 and bottom region 420, so as to form an enclosed bladder 140. For example, the top region 410 and bottom region 420 are circular shaped and the convex outer wall 430 is provided around (encompasses) the circular shaped top and bottom regions 410, 420. In an alternative embodiment, the first side 430 has a wedge shape, which is provided around, for example, a square shaped top and bottom region 410, 420. The bladder 140 is not limited to a circular disk, for example, the bladder 140 may be embodied as a box, egg-shape, rectangular, cylindrical, or any other suitable shape.

In one presently preferred embodiment the bladder 140 is embodied as a circular tube. As shown in FIG. 4A, the bladder 140 is shaped as a ring with a diameter D. The diameter D is preferably between 4 and 50 feet, more preferably of about 16 feet. As shown in FIG. 4A, the top region 410 is circular with a circular portion missing from the center of the top region 410. The bottom region 420 also has a circular portion missing from the center. In this embodiment, an inner wall 440 is provided between the top and bottom region 410, 420, so as to enclose the bladder 140. The circular missing portion is the inner section 111 and has a radius R. The radius R is preferably between 6 inches and 10 feet, more preferably of about 4 feet. In one embodiment, the inner section $I_s$ is used as a space for the displacement of the bladder section when a force is applied to the bladder 140 or, alternatively, is used as a space to store additional elements, for example, a compressor, generator, hoses, electrical chords, storing device or other suitable elements.

Figure 5:
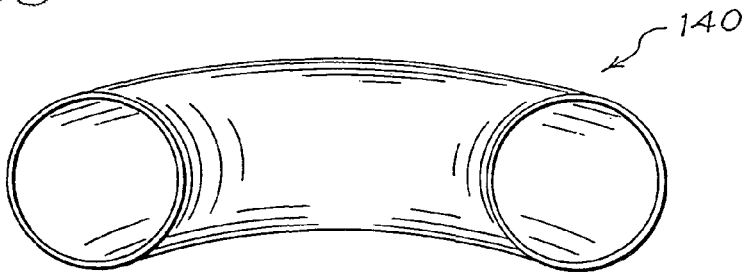
FIG. 5 is a cross sectional view of one embodiment of an inflatable bladder.

In one embodiment, as partially shown in FIG. 5, the bladder 140 is embodied as a torus with a circular cross-section. For example, the torus has a doughnut-shaped surface. This surface is illustrated by revolving a circle in a three dimensional space about an axis coplanar with the circle, which does not touch the circle. The torus has a "hole" at the revolution axis. As broadly described herein, the "hole" is an inner region that is not embodied by the torus. In alternate embodiments, the bladder 140 is embodied as, for example, an automobile wheel inner tube.

In one embodiment, the volume of the bladder 140 is about 9.5 $m^3$, however, the volume of the bladder 140 is not limited to this volume. The volume depends on the circular tube width $T_W$ and the circular tube height $T_H$. The circular tube width $T_W$ and the circular tube height $T_H$ are set based on the predetermined height of the platform 100. As shown in FIG. 4A, the circular tube width $T_W$ is the distance between the radius of the circular top region 410 and the radius of the inner section $I_s$. As shown in FIG. 4B, the circular tube height $T_H$ is the distance between the top region 410 and the bottom region 420. For example, it is presently preferred that the circular tube height $T_H$ is preferably between about 1 foot and 5 feet, more preferably of about 2 feet. The circular tube width $T_W$ is preferably between about 3 and 30 feet, more preferably of about 15 feet. However, as embodied in FIG. 12, the $T_H$ is between about 5 feet and 75 feet.

In one embodiment, the bladder 140 comprises a flexible material. For example, the bladder 140 can be fabricated of various materials including, but not limited to, rubber, reinforced rubber, a vinyl coated fabric or other suitable material. In one embodiment, when filled with a suitable substance the bladder 140 has a rigid form and is able to resist a force without the shape of the bladder 140 being substantially deformed.

The bladder 140 is air-tight and durable. In one preferred embodiment, the bladder 140, when charged with a compressed substance, is able to resist a force from the first substrate 130 without releasing air or rupturing. In one exemplary embodiment, the material is operable to stretch without rupturing. For example, when a force is applied to the top region 410 of the bladder 140 and the bladder is filled with compressed air, the top region 410 is depressed toward the bottom region 420 (i.e. $T_H$ is reduced). In this example, the compressed air is displaced horizontally to the first side 430 that is operable to suitably stretch (i.e. $T_W$ is increased) to a desired width. However, in an alternative embodiment, the bladder 140 does not stretch at all. For example, when the bladder 140 has finished stretching to the desired width, the air pressure inside the bladder 140 is increased as the force is applied to the top region 410 of the bladder 140. At some point the bladder 140 will be rigid enough to increase the pressure (psi) inside the bladder 140 as a force is applied to any or all sides of the bladder 140.

This force includes, but is not limited to, the force created by the weight of the first substrate 130 and its cargo; the force of the cable supports attached to the first substrate 130, the force of gravity, and any other suitable forces. In one exemplary embodiment, the bladder 140 is capable of supporting a force preferably between 2,000 and 10,000 pounds, more preferably the bladder is capable of supporting a force of about 5,000 pounds.

In one embodiment, the bladder 140 thickness is preferably between 1/16 inch and 1/2 inch, more preferably 1/8 inch. The thickness of the bladder 140 is not limited to these thicknesses. For example, the thickness can be smaller or larger depending on the material used to form the bladder 140.

Figure 9:
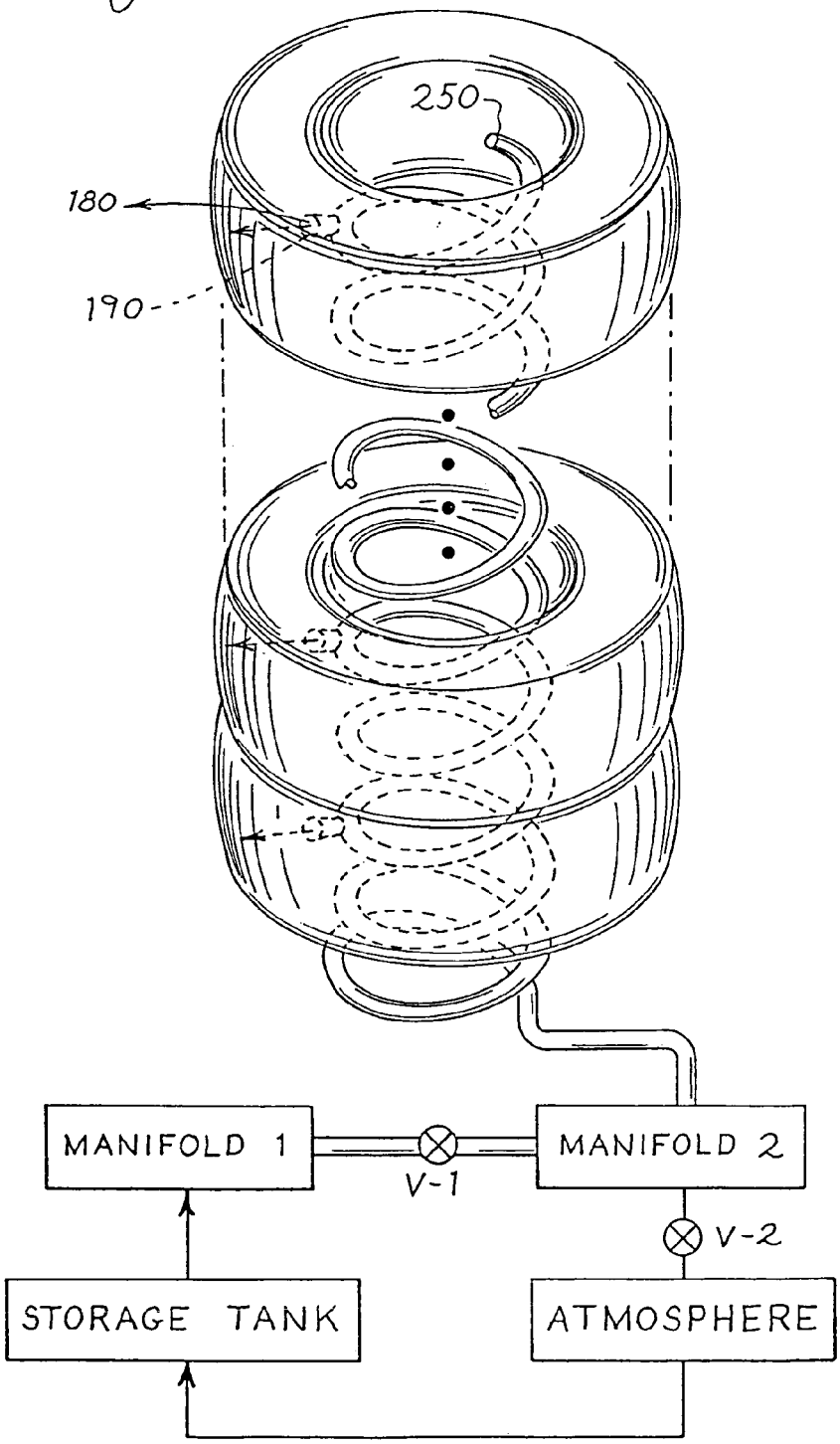
FIG. 9 is a perspective view of the air flow of one embodiment of the elevated platform.
Figure 13:
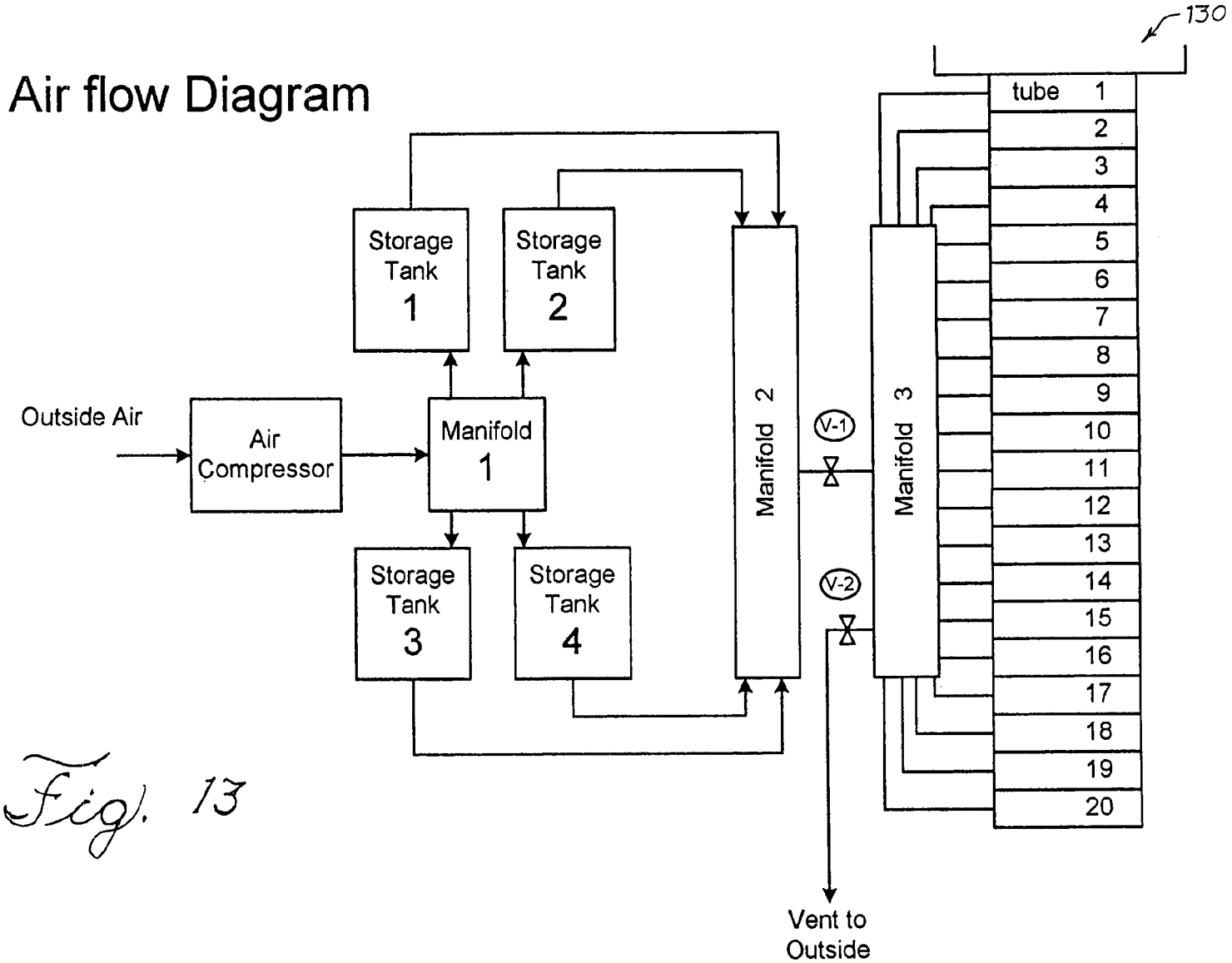
FIG. 13 is an exemplary air flow diagram of an elevated platform.

In one embodiment, as shown in FIG. 4A, the bladder 140 includes a valve 180. The valve 180 is operative to input or output a substance from the bladder 140. In this embodiment, the valve 180 includes a hole in the bladder 140. As shown in FIG. 9, the valve 180 is coupled to a hose 190. As shown in FIG. 13, the valve 180 is directly or indirectly coupled to a third manifold. In one preferred embodiment, the valve 180 is a hole in the bladder 140 that is coupled to the third manifold via a tube. However, the valve is not limited to this embodiment; for example, the valve 180 can be embodied as a solenoid valve and be directly coupled to the atmosphere.

In another embodiment, a plurality of valves 180 are provided. The plurality of valves 180 can be individually controlled so as to control the flow of the substance from the bladder 140 to the first manifold. A control box 1120 can be coupled to the valves 180 and operable to individually control each valve 180, so that the amount of air flowing through each valve 180 is automatically controlled.

In one embodiment, the valve 180 comprises an inlet or outlet in the bladder 140. As shown in FIG. 4A, the valve 180 comprises a circular hole in the bladder 140. The diameter of the circular hole is preferably between 1 inch and 5 inches, more preferably of about 2 inches. The present embodiments are not limited to a circular valve 180, for example, the valve 180 may comprise a plurality of holes, a rectangular hole, a funnel, or any other suitable means for releasing or inputting air into or out of the bladder 140.

The valve 180 may comprise of any suitable form. Exemplary suitable embodiments for the valve 180 include, but are not limited to, a ball valve, gate valve, an electric solenoid valve, or a manual screw.

In one embodiment, as shown in FIG. 2, the bladder 140 comprises a plurality of bladder sections 205. There is no limit to the number of different bladder sections 205 that may be provided. The number of different bladder sections 205 depends on the desired predetermined height of the first substrate 130 and the size of each bladder section 205. The plurality of bladder sections 210 can take any suitable form. Each of the plurality of bladder sections 205 can be embodied as described above for the bladder 140. As broadly described herein, the plurality of bladder sections 205 may comprise an arrangement that has been described in one of the embodiments of the bladder 140 or illustrated in the drawings or any suitable combination thereof. For example, in one embodiment, each of the plurality of bladder sections 205 may be shaped as inner tubes, as described above and shown in FIGS. 4A-4B. In another exemplary embodiment, each of the plurality of bladder sections 205 are inflatable with a suitable substance.

The plurality of bladder sections 205 are not limited to substantially the same shape and design as shown in the drawings. Any suitable combination of plurality of bladder sections 205 can be provided. For example, two of the plurality of bladder sections may be rectangular shaped (not shown) and the other bladder sections may be embodied as circular tubes as described above.

In one embodiment, as shown in FIG. 4B, each of the plurality of bladder sections 205 comprise a top region 410, a bottom region 420, and an outer wall 430. The top region 410 and bottom region 420 are substantially planar to each other and an outer wall 430 having a convex shape is coupled to the top region 410 and bottom region 420, so as to form an enclosed bladder section 205. In one preferred embodiment, as shown in FIG. 2, the plurality of bladders sections are aligned with and disposed on each other. In this embodiment, the inner section $I_S$ of each of the plurality of bladder sections 205 is aligned with the other inner sections of the other bladder sections 205.

In one embodiment, the top region 410 of one of the plurality of bladder sections is coupled to a bottom region 420 of a second of the plurality of bladder sections. The plurality of bladder sections 205 are coupled to each other by, for example, soldering, stitching, molding, or other suitable attachment mechanisms. For example, in one embodiment, the plurality of bladder sections 205 are manufactured so as to be one large bladder with a plurality of smaller bladders aligned with each other, within the large bladder. In one embodiment, the plurality of bladder sections 205 are individually inflatable and embodied as a torus, hexagon, octagon, or any other suitable shape, as discussed above and shown in FIG. 4B.

As shown in FIG. 2, at least one bladder section 205 is disposed between a first of the plurality of the bladder sections 205 that is coupled to the first substrate 130 and a second of the plurality of the bladder sections 205 that is coupled to the housing 110. In this embodiment, each of the plurality of bladder sections 205 are aligned with each other.

In one embodiment, each of the plurality of bladder sections 205 is inflatable. Each of the plurality of bladder sections 205 can be partially or completely filled with a suitable substance, such as, but not limited to, air. Each of the plurality of bladder sections 205 comprises a valve 180, as shown in FIG. 4A and described above with respect to the bladder 140. The plurality of valves 180 are individually coupled to the third manifold, either directly or indirectly. For example, indirectly through a hose 190, or directly coupled to the atmosphere. In one preferred embodiment, the plurality of bladder sections 205 are simultaneously inflated.

In one exemplary embodiment, only a percentage of the plurality of bladder sections 205 are inflated, so as to elevate the first substrate 130 to a desired predetermined height. In this embodiment, as shown in FIG. 2, the height H of the first substrate 130 depends on the number of the plurality of bladder sections that are fully inflated, which is controlled by a control box 1120. Further, in this embodiment, the first of the plurality of bladder sections 205 that is inflated is the bladder section 205 that is coupled to the first substrate 130. The next bladder section 205 that is inflated is the bladder section that is coupled to the first of the plurality of bladder sections 205 that was inflated. In this exemplary embodiment, the valves 180 are coupled to a control box 1120. The control box 1120 includes an electrical processor that is operative to receive a signal from a user and automatically control the valves 180 based on a predetermined process.

As shown in FIG. 2, the elevated platform 100 includes a first of the plurality of bladder sections 205 that is coupled to the first substrate 130, and the housing 110 is coupled to a second of the plurality of bladder sections 205. A top region of the first of the plurality of bladder sections 205 is coupled to a lower surface of the first substrate 130, and a lower region of the second of the plurality of bladder sections 205 is coupled to the housing 120. The plurality of bladder sections 205 can be coupled to the first substrate 130 and housing 110 in any suitable form. For example, the plurality of bladder sections 205 can be directly or indirectly coupled to the first substrate 130 and housing 110, as described above. In another example, the plurality of bladder sections 205 can be coupled to different areas of the first substrate 130 and housing 110, such as the corners or sides of the first substrate 130 and housing 110. As shown in FIG. 2, only one bladder section 205 is coupled to the first substrate 130 or housing 110; however, the elevated platform 100 is not limited to this arrangement; for example, a plurality of bladder sections 205 may be coupled to the first substrate 130, the housing 110, or both.

In one embodiment, as shown in FIG. 2, the elevated platform 100 includes a cable support 200. In one embodiment, the cable support 200 is fabricated with, but not limited to, woven steel. For example, the cable support 200 can be fabricated with nylon, chain links, or any suitable material.

In one embodiment, as shown in FIG. 2, the cable support 200 is coupled to and provides tension between the housing 110 and first substrate 130. For example, the support cable 200 connects a first corner Cs1 of the first substrate 130 to a second corner Ch2 of the housing 110, and the support cable 200 connects the first corner Ch1 of the housing 110 to the second corner Cs2 of the first substrate 130. As shown in FIG. 2, the support cable 200 crosses the support cable 200 at a position between the housing 110 and the first substrate 130.

In one preferred embodiment, the support cable 200 connects each corner of the housing 110 to a corner of the first substrate, which crosses the support cable 200 at each side thereof. For example, the support cable 200 connects a second corner Cs2 of the first substrate 130 to a third corner Ch3 of the housing 110, and the support cable 200 connects the second corner Ch1 of the housing 110 to the third corner Cs2 of the first substrate 130. In another example, also shown in FIG. 2, the support cable 200 connects a third corner Cs1 of the first substrate 130 to a fourth corner Ch2 of the housing 110, and the support cable 200 connects the third corner Ch1 of the housing 110 to the fourth corner Cs2 of the first substrate 130. In yet another example, the support cable 200 connects the fourth corner Cs4 of the first substrate to the first corner Ch1 of the housing, and the support cable 200 connects the fourth corner Ch4 of the housing to the first corner Cs1 of the first substrate.

Although not illustrated in the drawings, the support cable 200 does not need to cross the support cable 200. For example, the support cable 200 may be connected between the first corner of the housing Ch1 and the first corner of the first substrate Cs1, and may be connected between the second corner of the housing Ch2 and the second corner of the first substrate Cs2. The combination of embodiments is not limited, for example, the support cable may comprise both a crossing section and a non crossing section, as described above.

The location of bladder 140, plurality of bladder sections 205 and the cable support 200 is not limited. In an alternate embodiment, as shown in FIG. 2, a bladder 140 can be disposed at the edges of the housing 110 and first substrate 130 with the cable support 200 provided in the middle of the bladder 140. In one embodiment, the cable support 200 is coupled to, for example, a center point of an edge of the first substrate 130 and the housing 110.

The elevated platform 100 includes an elevated position, which has all of the bladder sections 205 inflated, and a resting position, which has all of the bladder sections 205 emptied. For example, when the elevated platform 100 is in the resting position, it may be loaded and unloaded with, for example, people and cargo. As discussed above, in the resting position, the elevated platform 100 may rest, directly or indirectly, on the housing 110.

In one preferred embodiment, the elevated platform includes a plurality of cable supports 200. In this preferred embodiment, the plurality of cable supports 200 may connect as described above for the support cable 200. In one exemplary embodiment, the plurality of cable supports 200 connect two or more corners or edges of the first substrate 130 and housing 110. The plurality of cable supports 200 may individually provide tension to the first substrate 130. For example, by pulling on one of the plurality of cable supports 200, the corner that the one of the plurality of cable supports is located will be moved in the direction of the force of the pull, however, the other corners will not be substantially affected. This embodiment allows the plurality of cable supports to provide different tension forces to, for example, the corners of the first substrate where the cable supports are respectively connected.

In one embodiment, the plurality of cable supports 200 are directly or indirectly coupled to the housing 110 and first substrate 130. In one preferred embodiment, one end of one of the plurality of cable supports is rigidly connected to the first substrate via, for example, a hook or latch. Alternatively, the other end of the one of the plurality of cable supports is coupled to the housing 110, as shown in FIG. 10, through a tunnel 210. The tunnel 210 can be provided at each corner Ch1, Ch2, Ch3, Ch4 of the housing 110. The cable support 200 is provided into and out of the tunnel 210.

In one embodiment, on at least one side of the housing 110, a pulley 220 is provided. One of the plurality of cable supports 200 engages the pulley 220. The pulley 220 is operative to redirect the support cable 200. The pulley 220 directs the cable support 200 to, for example, another pulley, a rolling drum, or other suitable device, without generating excess friction that causes wear to the cable support 200. In one preferred embodiment, as shown in FIG. 10, the pulley 220 is disposed outside of the tunnel. However, the pulleys 220 location is not limited to being disposed at this location, for example, the pulley 220 can be disposed inside the tunnel 210 or on top of the housing 110. Alternatively, multiple pulleys can be disposed at each corner of the housing 110 or first substrate 130.

In one embodiment, the elevated platform 100 includes an actuator 280 that is operatively coupled to the support cable 200, so as to provide a tension to the support cable 200. In a preferred embodiment, the actuator 280 includes a rotation drum and motor. The cable support 200 is wound on the actuator 280, so that the cable support 200 become taunt. The actuator 280 is operative to rotate. In one direction of rotation, the actuator 280 winds the cable support 200 around the actuator 280. In the other direction of rotation, the actuator 280 unwinds the cable support 200 from around the actuator 280. It is preferable that the actuator 280 is a rotation drum coupled to a motor; however, the actuator 280 is not limited to this arrangement. For example, the actuator 280 can include any suitable mechanism for tightening the cable support 200.

In one preferred embodiment, the elevated platform 100 includes a plurality of actuators 280 that are individually connected to one or more of the plurality of support cables 220. In this embodiment, a control box 1120 can operatively control each of the actuators 280 to generate more tension on the cable support 200 or give more slack to cable support 200. The rolling drum operates by rolling the cable support 200 onto a drum. When the cable support 200 is attached to the first substrate 130 via one or more pulley 220, the actuator will provide a "pulling" downward sensation to the first substrate 130 by rotating the drum so as to shorten the support cable 220. Conversely, if the actuator "unwinds" the support cable 220, the tension in the support cable 220 is reduced.

In one embodiment, as shown in FIG. 5, the housing 110 includes a storage tank 620, a compressor 610, and a generator 630. The housing 110 can take any suitable form, as described above. For example, as shown in FIG. 5, the storage tank 620, the compressor 610, and the generator 630 can be disposed in and arranged at the bottom of the housing 110. In alternate embodiments, the storage tank 620, the compressor 610, and the generator 630 are disposed on the outside of the housing 110.

As shown in FIG. 5, the housing 110 has a rectangular cross-section. In this embodiment, the length L of the housing 110 is preferably between about 4 and 64 feet, more preferably of about 16 feet. The width W of the housing 110 is preferably between about 4 and 64 feet, more preferably of about 16 feet. The housing 110 is not limited to a rectangular cross-section, for example, the housing can have a circular, triangular, hexagon, or any suitably shaped cross-section.

Figure 8:
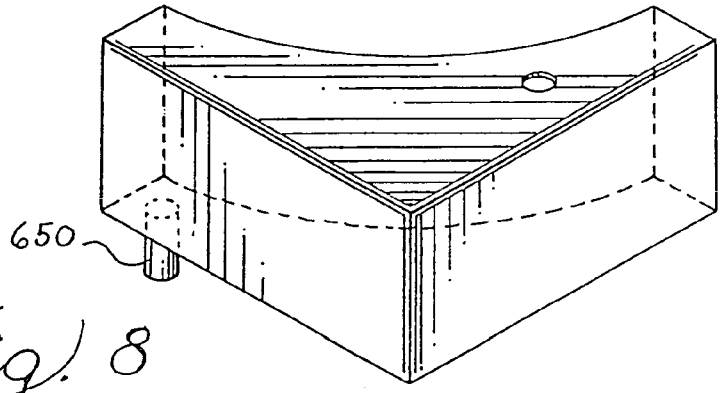
FIG. 8 is a perspective view of one embodiment of a storage tank.

In one embodiment, as shown in FIG. 5, the storage tank 620 encompasses a circular bladder 140. As shown in FIG. 8, the storage tank 620 includes a curved side S-3 that substantially matches the shape and radius of the circular bladder 140. The outer edge S-1, S-2 of the storage tank 620 substantially matches the shape of the housing 110, for example, the outer edge of the storage tank 620 is rectangular.

Figure 6:
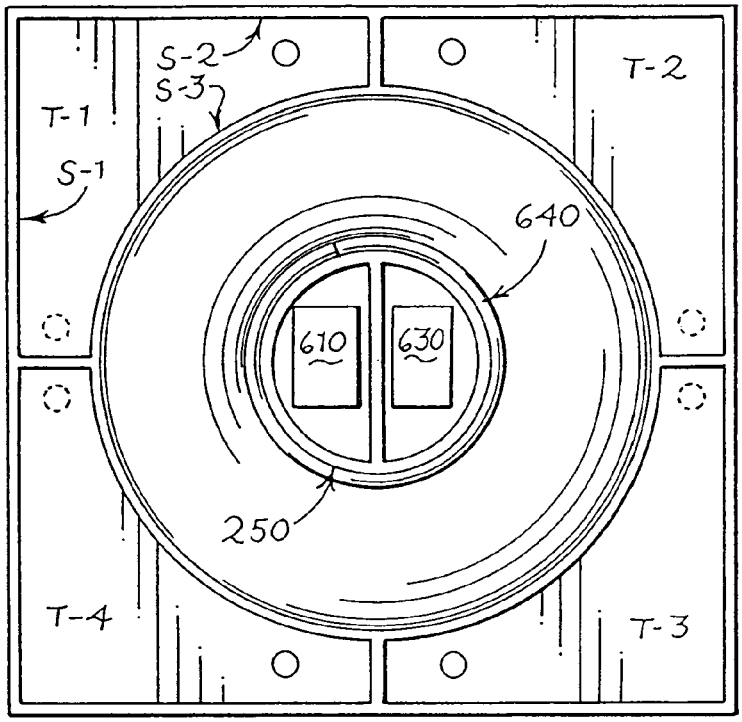
FIG. 6 is a top view of one embodiment of a housing.

In another embodiment shown in FIG. 6, the circular bladder 140 includes a circular hole at the center of the circular bladder 140. The compressor 610 and the generator 630 are provided inside the circular hole 640. In an alternate embodiment, the circular hole 640 also includes hoses and cables (not shown) that are coupled to the compressor 610 and generator 630.

As broadly described herein, the storage tank 620 is directly or indirectly coupled to the compressor 610, which is directly or indirectly coupled to the generator 630 and bladder 140. For example, the storage tank 620 is indirectly coupled to the compressor through a first manifold, as shown in FIG. 13. The generator 630 is operatively coupled to the compressor 610.

In one embodiment, the generator 630 is operative to actuate the compressor 610 and, for example, the control box 1120 and other suitable components. In one exemplary embodiment, the generator 630 is a gasoline operated generator. However, in an alternate embodiment, the generator 630 is electrically powered. For example, the generator 630 can be about 110 volt source and 240 volt source. The generator 630 can be an alternating current (AC) source or a direct current (DC) source and can be converted between AC and DC as needed.

A compressor 610 is operatively coupled to fill the storage tank 620 with a compressed substance. In one embodiment, the compressor 610 compresses a substance, for example, air. In this embodiment, air from the atmosphere is supplied to the compressor 610. The compressor 610 is operative to compress air up to at least 250 psi. In one exemplary embodiment, the compressor 610 compresses atmospheric air to 200 psi and supplies the air to a first manifold, as shown in FIG. 13.

In a preferred embodiment, the compressor 610 is disposed outside of the storage tank 620. However, in an alternate embodiment, the compressor 610 can be disposed at any suitable location; for example, the compressor 610 can be disposed in the storage tank 620. In this embodiment, the storage tank is supplied with atmospheric air and the compressor compresses the air inside the storage tank.

In one embodiment, the first manifold is a tube or set of tubes that is operative to transport or house air or other suitable substances. For example, in one embodiment, air is compressed by the air compressor 610 and supplied to the first manifold. The air enters the first manifold and evenly dispenses to a plurality of tank sections.

As shown in FIG. 6, the storage tank 620 includes a plurality of storage tank sections T-1; T-2; T-3; T-4. As shown in FIG. 8, the storage tank sections T-1; T-2; T-3; T-4 include a substantially enclosed, hollow inner area that stores a suitable substance, for example, air, water, or helium. Each storage tank section T-1; T-2; T-3; T-4 is coupled to a first manifold and a second manifold.

In one embodiment, the storage tank section T-1; T-2; T-3; T-4 includes a first side S-1; second side S-2; and curved side S-3. The storage tank section T-1; T-2; T-3; T-4 is enclosed with a top edge and bottom edge and is enclosed, so as to be air-tight. For example, in one embodiment, the storage tank 620 is preferably able to store between 1000 cubic feet of air and 25,000 cubic feet air, more preferably about 12,800 cubic feet of air. The storage tank 620 is embodied to maintain air at a greatly increased psi, for example, the air is maintained at a psi between about 100 and 300 psi, more preferably at about 200 psi.

In one embodiment, the storage tank 620 is manufactured with steel. However, any suitable material may be used. In this embodiment, because the air is stored at such an increased psi, the compressed air is likely to erode the sides of the storage tank 620 with condensation. Thus, the inside of the storage tank is lined with a rust-resistant material.

In one embodiment, as shown in FIG. 13, the storage tank 620 is coupled to a second manifold. In this embodiment, air from the storage tank sections T-1; T-2; T-3; T-4 is evenly dispensed to the second manifold. The second manifold is coupled to one side of a valve V-1. The other side of valve V-1 is coupled to a third manifold. The valve V-1 is operable to be "open" and "closed." When the valve V-1 is "open" a suitable substance is operable to flow between the second manifold and the third manifold. When the valve V-1 is "closed" the suitable substance is maintained in the second manifold without flowing to the third manifold. The valve V-1 is operatively coupled to a control box. The control box is operable to open and close the valve V-1. The valve V-1 can take any suitable form. An example of a suitable valve V-1 is a solenoid valve.

The third manifold is operatively coupled to the bladder 140 or bladder sections 205. When the valve V-1 is "opened" the suitable substance fills the third manifold. The third manifold then evenly disperses the suitable substance to the bladders 205. The third manifold and bladder 140 can be coupled together with suitable sized tubes.

In one embodiment, as seen in FIG. 13, the third manifold includes a valve V-2. The valve V-2 is coupled between the third manifold and the atmosphere. The valve V-2 is operable to be "opened" and "closed." When the valve V-2 is "open" a suitable substance is operable to flow between the third manifold and the atmosphere. When the valve V-2 is "closed" the suitable substance is maintained in the third manifold. The valve V-2 is operatively coupled to a control box 1120. The control box 1120 is operable to open and close the valve V-2. The valve V-2 can take any suitable form. An example of a suitable valve V-2 is a solenoid valve. The valve V-2 is relatively large because of the pressure difference that occurs at the valve V-2. The size of the valve V-2 is selected so as to prevent the valve V-2 from collecting moisture and freezing as a substance is channeled into and out of the third manifold. It is presently preferred that the valve V-2 have a diameter of between about 2 inches and 8 inches, more preferably about 4 inches.

Figure 7:
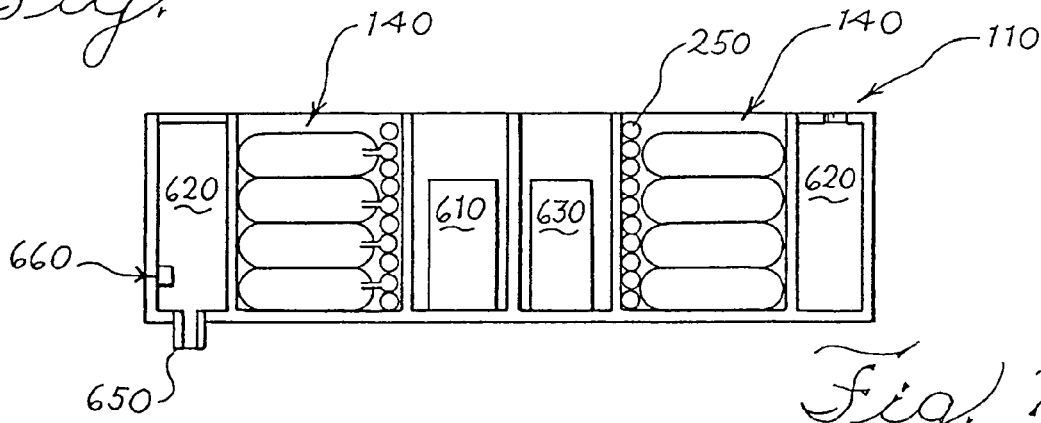
FIG. 7 is a cross sectional view of one embodiment of a housing.

In one embodiment, as shown in FIG. 7, the storage tank 620 includes a drain 650. The drain 650 is disposed at, for example, the lowest point of the housing and is operative to drain any excess water that accumulates in the housing 110. The drain 1150 can include a cylindrical pipe that is disposed in a circular hole (not shown) in the housing 110. The drain 1150 empties accumulated water in the storage tank 620 tank, which eliminates the possibility of the storage tank rusting or supplying water into the first manifold. Alternatively, the drain 1150 can be embodied as an electrical solenoid valve. In one embodiment, the drain 1150 is coupled to the control box 1120. An example of a suitable drain is the automated drain (model RF-2011) from Motor Guard. In one preferred embodiment, the drain 650 is operable to be "opened" and "closed." When a substance is being stored in the storage tank 620, the drain 650 is "closed," which means that the water is not able to escape from the storage tank. However, when the required amount of air has been transferred to the bladder 140 and the valve V-1 has been "closed" the drain 650 is "opened," which means that the water is drained from the storage tank 620.

In another embodiment, as shown in FIG. 6, the storage tank 620 includes a dryer 660. The dryer 660 is operable to remove any accumulated water in the storage tank 620. The dryer can take any suitable form.

The housing may further include a storing device 250 that stores the filling tubes 190 and/or electrical cords 260. The filling tubes 190 that are coupled to the third manifold and the bladder sections 205 must be able to operate at an elevated height without being tangled or snagged. The tubes 190 should easily rise to the level of the first substrate. In one embodiment, the housing 110 comprises a storing device 250 with a helix shaped substrate that is expandable to a predetermined height, as shown in FIG. 2. A bottom section is coupled to the housing. The tubes 190 and/or the cords 260 are connected to the helix shaped substrate. As shown in FIG. 2B, the tubes 190 and cords 260 can be disposed on one side of the helix shaped substrate. In this embodiment, a section of the tube 190 connects to each bladder section. The signal cords 260 are coupled to the first substrate 130. For example, the signal cords 260 can provide power from the generator to a control box on the first substrate and the signal cords can provide a connection between the control box and plurality of valves V-1, V-2; storage tank drain; or any other suitable device.

The storing device 250 includes a first position and a second position. The first position is a loading position with a platform substantially resting on the housing. The second position is an elevated position with the platform located at an elevated position above the housing 110. The helix shaped substrate is operative to return to the first position after being stretched to a second position. The storing device 250 prevents the filling tubes 190 and signal cords 260 from being snagged or tangled.

In one embodiment, the storing device 250 includes metal, plastic, or both. However, the device can take any suitable form that allows the device to be stretched to a second position and return to a first position.

Figure 2A:
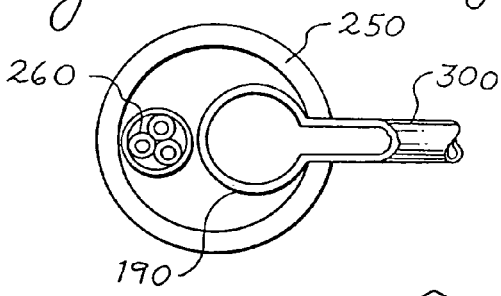
FIG. 2A is a cross sectional view of a storing device according to one embodiment.
Figure 2B:
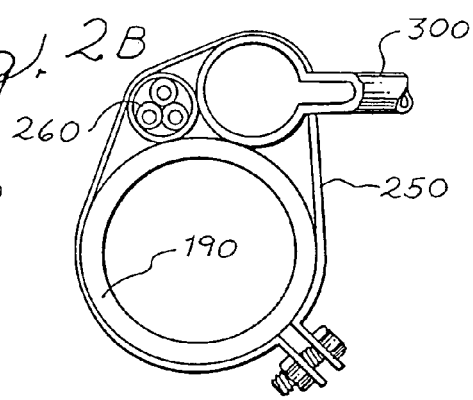
FIG. 2B is a cross sectional view of a storing device according to one embodiment.

In an alternative embodiment, as shown in FIG. 2A, the storing device 250 includes a hollow inner section that is operatively sized to house the tubes 190 and/or cords 260. The first substrate has a feed opening 300 that connects the tubes 190 and/or cords 260 to their respective destination. For example, a bladder section 205 disposed at 15 feet above the housing is operatively coupled to the storing device 250 at 15 feet above the housing. However, the bladder section 250 is always operatively coupled to the storing device, for example, at a resting position in the housing 110.

In one embodiment, the elevated platform 100 includes a booster tube. The booster tube is used to provide elevation after a majority of the bladder sections 205 have been inflated. In this embodiment, the storage device 250 may comprise multiple sections T-1; T-2; T-3; T-4 having different amounts of pressure inside the tanks. For example, if T-1 has an increased pressure (psi) and is coupled to the booster tube via valve (not shown) the valve can be operatively coupled to inflate the booster tube.

In one embodiment, the elevated platform 100 includes a leveling system that levels an elevated platform 100. The leveling system includes a sensor operatively coupled to a control box 1120 and the first and second support cables 220. A sensor is operative to sense a tension on the first and second support cables. The sensor 270 sends a tension signal to the control box 1120. The control box then controls (i.e. tightens or loosens) the tension on the first and second cable supports based on the tension signal. In this embodiment, the sensor can be embodied at various positions. For example, the sensor 270 can be positioned at the position where the cable supports 220 couple to the first substrate 130. However, the sensor can be located at any suitable location, for example, on the support cable, on a rolling drum, on a pulley, or any other suitable position.

In one embodiment, the control box 1120 is operatively coupled to a roller drum 280 that includes a motor. The roller drum 280 is coupled to the support cables 220. Based on the tension signal sent to the control box 1120, the roller drum 280 operatively tightens or loosens each cable support 220 based on the tension in the cable supports 220. For example, each cable support 220 may be coupled to a sensor 270. The control box 1120 then is able to control (i.e. tighten or reduce) the tension in each cable support 220 based upon the tension of all of the cable supports 220.

Figure 11B:
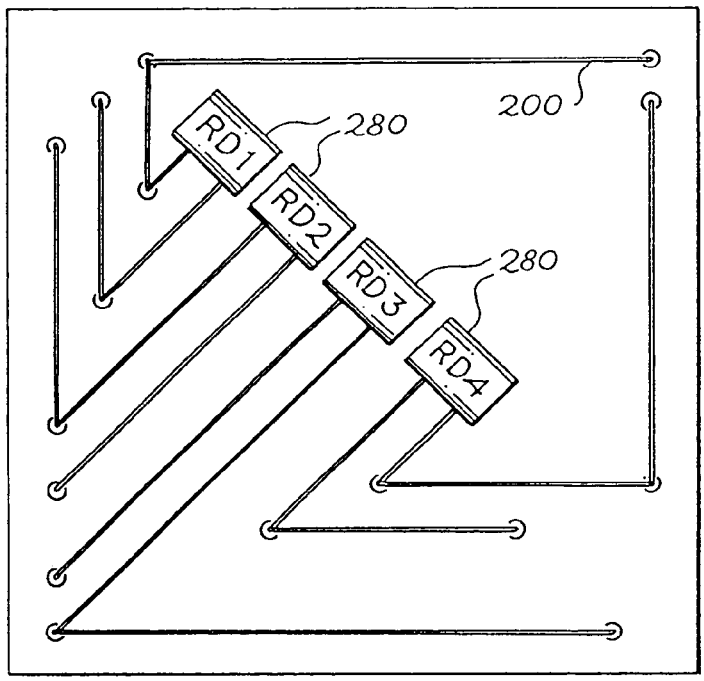
FIG. 11B is a bottom view of one embodiment of the housing.

In one embodiment, the roller drum 280, as shown in FIG. 11B, comprises a plurality of roller drums RD1, RD2, RD3, RD4. In this embodiment, the roller drums may be embodied as winches, however, the roller drums are not limited to this embodiment. For example, the roller drums may comprise any suitable device that is operative to provide tension to the cable support and then be operative to remove the tension. The control box 1120 may be operatively coupled to the roller drum 280 or roller drums RD1, RD2, RD3, RD4.

As shown in FIG. 11B, in one embodiment, the elevated platform 100 includes a plurality of rolling drums RD1, RD2, RD3, RD4 coupled to different cable supports 220.

In one embodiment, the leveling system levels the elevated platform 100 as the bladders 140 are filled. In this embodiment, the leveling system is able to level the platform as it is elevated above the housing 110.

In an alternate embodiment, the control box is coupled to a pressure sensor that measures the pressure in each bladder section. The control box provides tension to the cable supports based on the pressure in each bladder. However, the leveling system may include sensors 270 at any suitable location. For example, the leveling system may be coupled to a digital level placed on the elevated platform. In this embodiment, the control box provides a tension to the cable supports based on how level the actual platform is.

In one embodiment, a method for elevating a platform includes providing a suitable substance to a compressor. The compressor compresses the suitable substance and transfers the compressed substance to a first manifold, which evenly disperses the compressed air to a storage tank. The compressed substance is used to fill a bladder. In one embodiment, the compressed substance is air. In this embodiment, the bladder is filled with pressurized air between about 2 psi and 20 psi. A platform is coupled to the bladder and is elevated as the inflatable bladder is filled with the compressed substance. In this embodiment, the bladder may comprise a plurality of bladder sections and the bladder sections are operative to be filled with the compressed substance. The bladder section may be disposed on top of each other.

In one embodiment, a method for leveling a platform includes using a compressible tube between a first substrate and second substrate to elevate the first substrate, wherein a cable support is provided between the first substrate and the housing. The tension on the cable support is sensed with a sensor. Additional tension is provided or reduced on the cable support based on the tension of the cable support sensed by the sensor.

In one embodiment, a plurality of cable supports and a plurality of sensors can be used to sense the tension on the plurality of cable supports. Additional tension is provided or reduced from the tension to each of the plurality of cable supports based on the tension of the plurality of cable supports. A tension for each of the plurality of cable supports is calculated based on the tension in the cables, wherein the first substrate is substantially planar to the second substrate.

Figure 3:
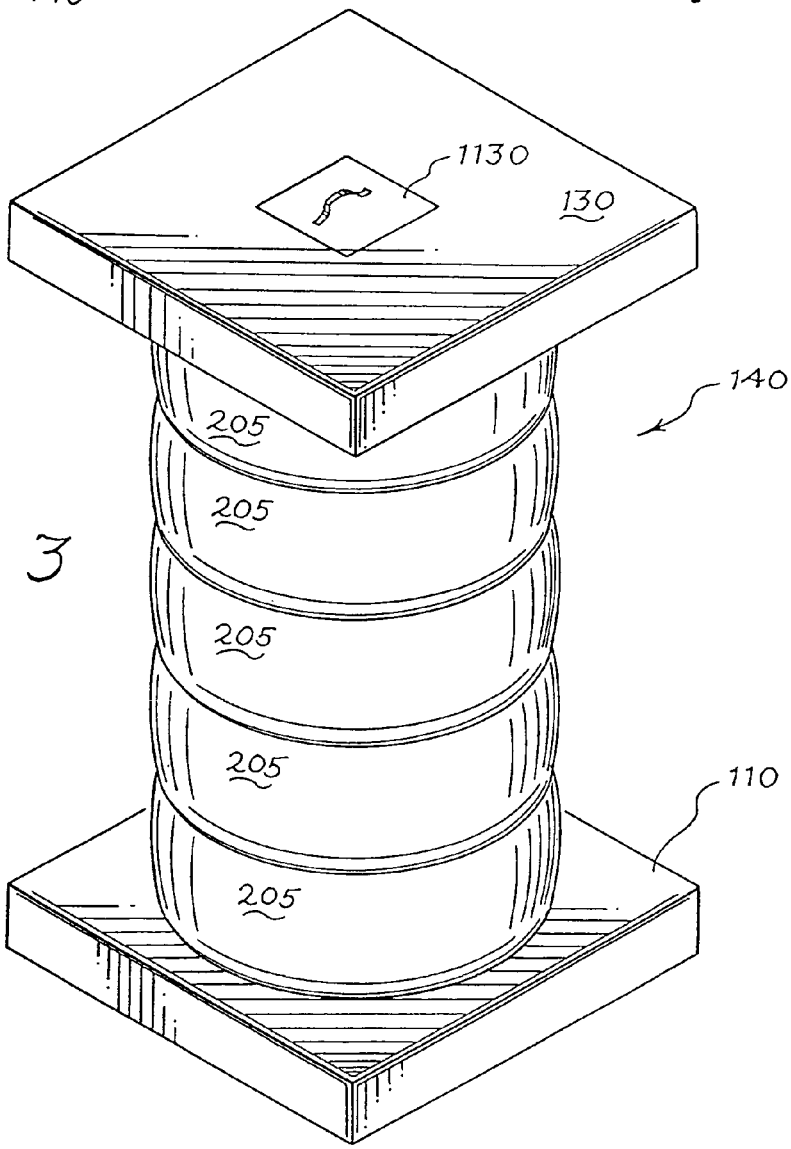
FIG. 3 is a perspective view of one embodiment of the elevated platform.

In one embodiment, the elevated platform 100 comprises a control box 1120. The control box 1120 may be operatively coupled to any suitable component. For example, the control box 1120 may be coupled to the valves V-1 and V-2, the air compressor, the roller drum 280 or any other suitable component. The control box 1120 may comprise of, for example, a computer processor unit (CPU). The control box 1120 may be placed at any suitable location on the elevated platform 100. For example, the control box 1120 may be placed directly below a user hatch 1130. As shown in FIG. 3, the user hatch 1130 may be placed on the first substrate 130 and operable to provide access to components below or inside the first housing 130. For example, the user hatch may be disposed over the compressor 610 and the generator 630 that are provided inside the circular hole 640.

As shown in FIG. 2, the elevated platform 100 may also comprise a user interface 1140. The user interface 1140 is operatively coupled to the control box 1120. The user interface 1140 allows the user of the elevated platform 100 to operate the elevated platform 100. The user interface 1140 is not limited to any shape or design. For example, the user interface 1140 may be operatively coupled via a wireless communication system, signal cords, or other suitable systems. The user interface 1140, as shown in FIG. 2, may be attached to the elevated platform 100, but is not limited to this embodiment, for example, the user interface may be disposed below the elevated platform. The user interface 1140 may be a remote control or other portable device. The user interface 1140 may be comprised of a computer processor unit (CPU). In an alternative embodiment, the control box 1120 and the user interface 1140 are embodied together.

Various embodiments described herein can be used alone or in combination with one another. The forgoing detailed description has described only a few of the many possible implementations of the present invention. For this reason, this detailed description is intended by way of illustration, and not by way of limitation. It is only the following claims, including all equivalents that are intended to define the scope of this invention.

The invention claimed is:

1. An elevated platform comprising:

a housing;

a platform;

a bladder comprising a first surface coupled with and operative to elevate the platform, the first surface being operative outside the housing; and a support coupled to the platform and extending through the bladder.

2. The elevated platform according to claim 1, wherein the bladder is inflatable.

3. The elevated platform according to claim 1, wherein the bladder comprises a plurality of bladder sections.

4. The elevated platform according to claim 3, wherein the plurality of bladder sections are inflatable.

5. The elevated platform according to claim 2, wherein the bladder is embodied as a circular tube with a hollow inner compartment.

6. The elevated platform according to claim 4, wherein at least one of the plurality of bladder sections is embodied as a circular tube with a hollow inner compartment.

7. The elevated platform according to claim 5, wherein the circular tube is ring-shaped.

8. The elevated platform according to claim 6, wherein the at least one of the plurality of bladder sections is ring-shaped.

9. The elevated platform according to claim 6, wherein a top region of one of the plurality of bladder sections is coupled to a bottom region of a second one of the plurality of bladder sections.

10. The elevated platform according to claim 6, wherein a first of the plurality of bladder sections is disposed on a second of the plurality of bladder sections.

11. The elevated platform according to claim 10, wherein the platform is coupled to the first of the plurality of bladder sections, and the housing is coupled to the second of the plurality of bladder sections.

12. The elevated platform according to claim 11, wherein at least one other of the plurality of bladder sections is disposed between the first and second of the plurality of bladder sections.

13. The elevated platform according to claim 2, wherein the bladder comprises reinforced rubber.

14. The elevated platform according to claim 3, wherein the plurality of bladder sections comprise reinforced rubber.

15. The elevated platform according to claim 1, further comprising at least one support cable.

16. The elevated platform according to claim 15, wherein the at least one support cable is coupled to the platform and the housing.

17. The elevated platform according to claim 16, wherein the platform comprises a first and second corner, and the housing comprises a first and a second corner, and wherein the at least one support cable connects the first corner of the platform to the second corner of the housing, and the at least one support cable connects the first corner of the housing to the second corner of the platform.

18. The elevated platform according to claim 17, wherein the platform comprises a third corner, and the housing comprises a third corner, and wherein the at least one support cable connects the second corner of the platform to the third corner of the housing, and the at least one support cable connects the second corner of the housing to the third corner of the platform.

19. The elevated platform according to claim 18, wherein the platform comprises a fourth corner, and the housing comprises a fourth corner, and wherein the at least one support cable connects the fourth corner of the platform to the third corner of the housing, and the at least one support cable connects the fourth corner of the housing to the third corner of the platform.

20. The elevated platform according to claim 19, wherein the at least one support cable connects the fourth corner of the platform to the first corner of the housing, and the at least one support cable connects the fourth corner of the housing to the first corner of the platform.

21. The elevated platform according to claim 20, wherein a first of the at least one support cable crosses a second of the at least one support cable.

22. The elevated platform according to claim 1, further comprising at least one telescoping rail coupled between the platform and the housing.

23. The elevated platform according to claim 1, wherein the housing comprises a storage tank.

24. The elevated platform according to claim 23, wherein the storage tank is operative to store compressed air.

25. The elevated platform according to claim 24, wherein the storage tank is operative to maintain the compressed air up to at least 250 pounds per square inch (psi).

26. The elevated platform according to claim 25, wherein the storage tank is operatively coupled to one end of a valve.

27. The elevated platform according to claim 26, wherein the bladder is operatively coupled to the other end of the valve.

28. The elevated platform according to claim 1, further comprising an air compressor operatively coupled to a storage tank.

29. The elevated platform according to claim 3, wherein each of the plurality of bladder sections is operatively coupled to a first valve, and wherein the first valve is operative to fill the bladder with a substance stored in a storage tank.

30. The elevated platform according to claim 29, wherein each of the plurality of bladder sections is operatively coupled to a second valve, and wherein the second valve is operative to release the substance from the bladder.

31. The elevated platform according to claim 23, wherein the housing comprises at least one pulley.

32. A device that controls the air flow of a pressurized bladder comprising:

a platform coupled to a pressurized bladder;

a first compartment operatively coupled to the pressurized bladder;

a first valve operatively coupled between a source of air and the first compartment; and a second valve operatively coupled between the first compartment and the atmosphere;

wherein a sensor is operatively coupled to a control box and senses the rate of descent of the platform; and wherein the control box is operative to control the second valve based on the sensed rate of descent.

33. The device according to claim 32, wherein the sensor is operatively coupled to the second valve and senses the rate of a substance being released from the bladder, and wherein the control box is operative to control the valve based on the rate the substance is released from the bladder.

34. The device according to claim 32, further comprising a platform coupled to the bladder.

35. The device according to claim 32, wherein a controller is operative to close the first valve when a predetermined pressure is released into the bladder.

36. The device according to claim 35, wherein the bladder comprises a plurality of bladder sections.

37. The device according to claim 33, wherein the second valve releases air at a given rate while maintaining between 2 psi and 20 psi in the bladder.

38. The device according to claim 32, wherein the bladder comprises a plurality of bladder sections.

39. The elevated platform of claim 1, further comprising a pressure sensor coupled to the bladder and operative to measure the pressure in the bladder.

40. The elevated platform of claim 39, further comprising a control box coupled to the pressure sensor, wherein the control box is operative to control the rate of a substance entering or leaving the bladder.

41. The elevated platform of claim 1, further comprising a railing coupled to a top surface of the platform and extending vertically upward from the top surface of the platform.

42. The elevated platform of claim 1, wherein the platform comprises a top surface having an area of at least 16 square feet.

* * * * *